US006615527B1

(12) United States Patent
Martin

(10) Patent No.: US 6,615,527 B1
(45) Date of Patent: Sep. 9, 2003

(54) TRIGGER MECHANISM

(76) Inventor: Derrick J. Martin, 3960 N. Usery Pass Rd., Mesa, AZ (US) 85207

( * ) Notice: Subject to any disclaimer, the term of this patent is extended or adjusted under 35 U.S.C. 154(b) by 0 days.

(21) Appl. No.: 10/184,577

(22) Filed: Jun. 28, 2002

(51) Int. Cl.[7] ..... F41A 19/12

(52) U.S. Cl. ..... 42/69.03; 42/69.01; 42/42.01; 42/42.03; 42/65; 42/20; 42/21; 42/22; 42/70.08; 89/146; 89/147; 89/154; 89/151

(58) Field of Search ..... 42/69.03, 69.01, 42/42.01, 42.03, 65, 20, 21, 22, 70.08; 89/146, 147, 154, 151

(56) References Cited

U.S. PATENT DOCUMENTS 2,931,120 A * 4/1960 Kolinko ..... 42/18
3,049,977 A * 8/1962 Reich ..... 89/154
3,503,149 A * 3/1970 Hedges et al. ..... 42/65
3,996,686 A * 12/1976 Baker ..... 42/65
4,158,926 A * 6/1979 Kordas et al. ..... 42/69.01
4,173,090 A * 11/1979 Baker ..... 42/67
5,160,796 A * 11/1992 Tuma et al. ..... 42/69.03
5,166,458 A * 11/1992 Yoo ..... 42/69.03
5,400,537 A * 3/1995 Meller et al. ..... 42/69.03
5,501,134 A * 3/1996 Milazzo et al. ..... 89/139
6,016,736 A * 1/2000 Ghisoni ..... 89/157
6,381,892 B1 * 5/2002 Szabo et al. ..... 42/70.08
6,385,888 B1 * 5/2002 Power ..... 42/65

* cited by examiner

*Primary Examiner*—Michael J. Carone
*Assistant Examiner*—John Richardson
(74) *Attorney, Agent, or Firm*—Parsons & Goltry; Robert A. Parsons; Michael W. Goltry

(57) ABSTRACT

In a firearm having a trigger assembly with a trigger nose, a hammer with a sear hook and a trigger notch, a disconnector and an automatic sear, an improvement including a notched bifurcating the sear hook of the hammer for receiving the disconnector in a past-cocked position. Further improvements include the trigger notch being offset rearwardly from a center of the pivot point resulting in a slightly changed angle away from an acute engagement angle with the trigger nose.

18 Claims, 5 Drawing Sheets

FIG. 2
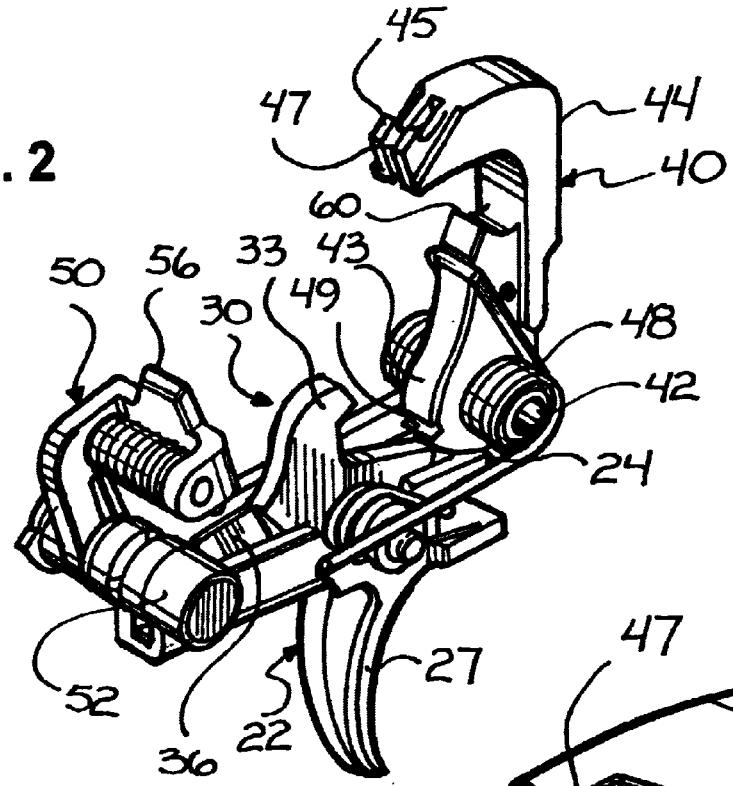
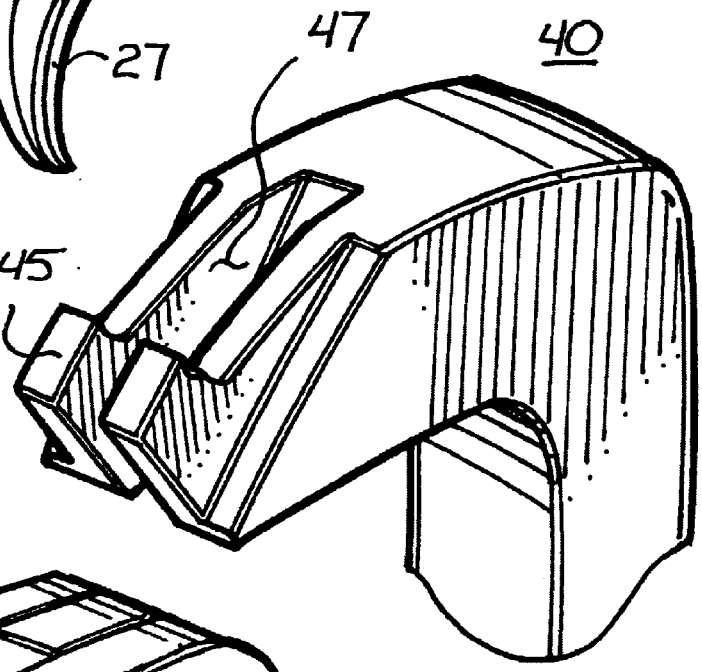
FIG. 7
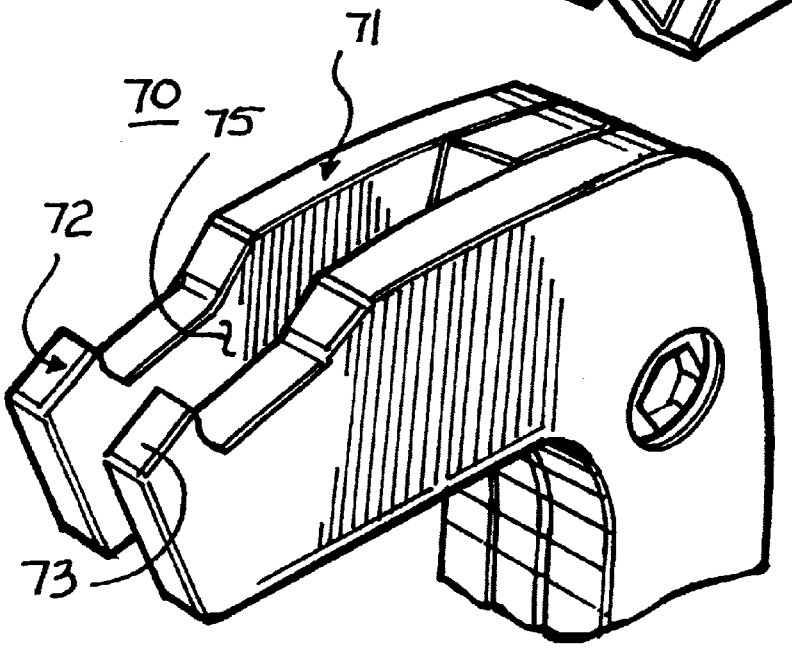
FIG. 13

FIG. 6
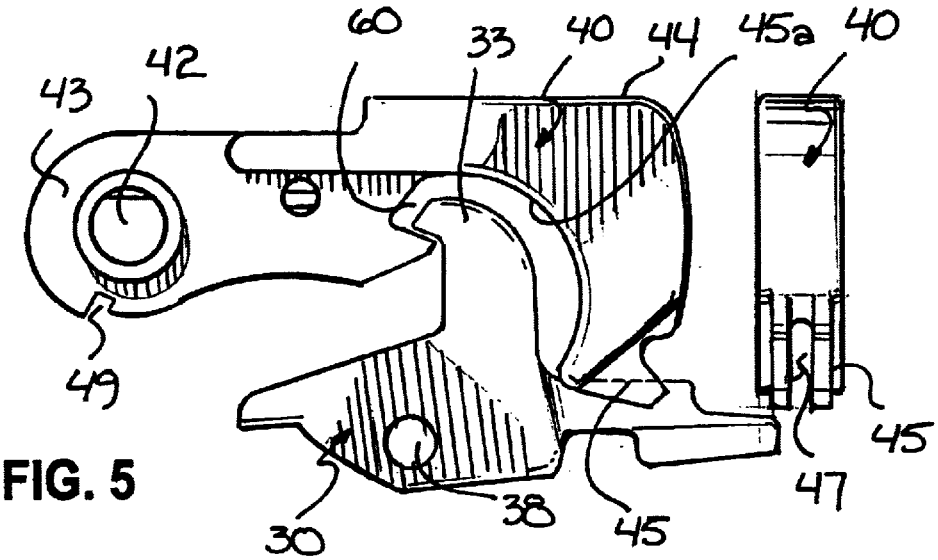
FIG. 5
FIG. 8
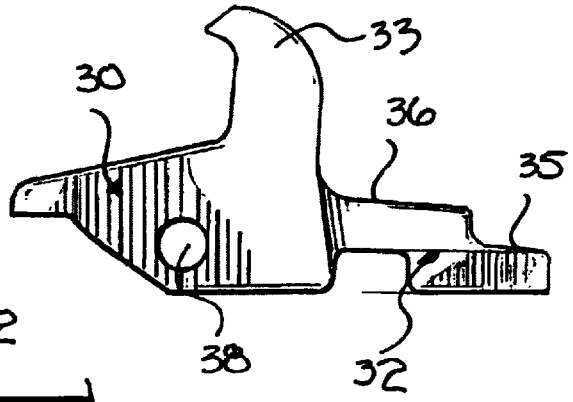
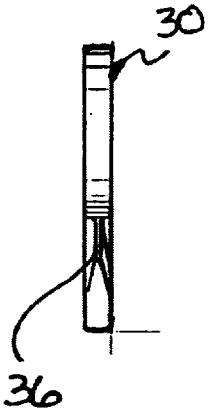
FIG. 10
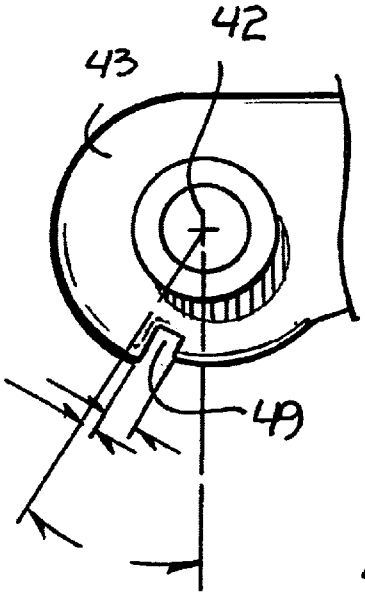
FIG. 14
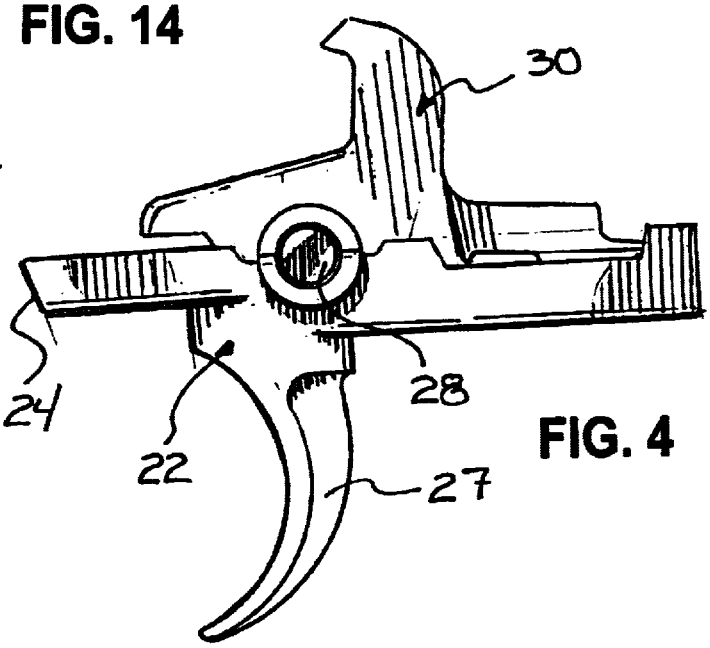
FIG. 4

TRIGGER MECHANISM

FIELD OF THE INVENTION

This invention relates to trigger mechanisms.

More particularly, the present invention relates to select fire trigger hammer disconnect mechanisms.

In a further and more specific aspect, the instant invention concerns trigger mechanisms in M16 type rifles.

BACKGROUND OF THE INVENTION

The M16 rifle is a well known and widely distributed firearm. There are many variations of this rifle and a correspondingly large number of modifications to the trigger mechanisms. The different variations include trigger mechanisms capable of being locked in a safe mode, of semi-automatic operation, of burst operation, and of fully automatic operation. Different variations of the rifle will allow some or all of the various modes of operation. Selector mechanisms have been developed for use with the trigger mechanisms to select between some or all of the various modes.

Whether the firearm is limited to safe, semi-automatic and burst and/or full automatic modes, one of the drawbacks to the trigger mechanism occurs when the hammer is returned to the cocked position by the bolt carrier. After firing a round, the bolt carrier moves rearwardly, contacting the hammer and pivoting the hammer backwards into the cocked position. This action results in the hammer striking the trigger assembly and transferring energy to an operator's finger upon the trigger in the form of a sharp snap or forward movement of the trigger. After repeated firings of the weapon, the snap of the trigger can begin to cause bruising or other injury to the finger, making continued firing uncomfortable.

It would be highly advantageous, therefore, to remedy the foregoing and other deficiencies inherent in the prior art.

Accordingly, it is an object of the present invention to provide a new and improved trigger mechanism.

Another object of the invention is to provide a trigger mechanism which greatly reduces or eliminates trigger snap.

SUMMARY OF THE INVENTION

Briefly, to achieve the desired objects of the instant invention in accordance with a preferred embodiment thereof, provided is a firearm including a lower receiver, a trigger assembly having a pivot pivotally coupling the trigger assembly to the lower receiver and a disconnector having a pivot pivotally coupling the disconnector to the pivot of the trigger assembly. A hammer has a pivot pivotally coupling the hammer to the lower receiver, the hammer being pivotable about a pivot point between a forward position, a cocked position and a past-cocked position. The hammer includes a bifurcated sear hook defining a notch, the disconnector being receivable within the notch in the past-cocked position.

In a specific embodiment, the bifurcated sear hook contacts the disconnector substantially in line with the pivot of the disconnector and the pivot of the trigger assembly in the past-cocked position. Additionally, the hammer includes a trigger notch formed proximate the pivot point, the trigger notch is offset rearwardly from a center of the pivot point resulting in a slightly changed angle away from an acute engagement angle with a trigger nose. The trigger nose has a lengthened forward surface and a radiused engagement edge.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 2 is a perspective view illustrating a trigger mechanism according to the present invention;

FIG. 4 is a side elevation of a trigger assembly and semi-automatic disconnector according to the present invention;

FIG. 5 is an enlarged side elevation of the hammer and semi-automatic disconnector according to the present invention;

FIG. 6 s an enlarged end elevation of the hammer according to the present invention;

FIG. 7 is an enlarged perspective view of the sear hook of the hammer according to the present invention;

FIG. 8 is a side elevation of the semi-automatic disconnector according to the present invention;

FIG. 10 is an end elevation of the semi-automatic disconnector;

FIG. 13 is an enlarged perspective view of the sear hook of the hammer of FIGS. 11 and 12; and FIG. 14 is an enlarged side elevation of the pivot end of the hammer.

DETAILED DESCRIPTION OF THE PREFERRED EMBODIMENT

Figure 1:
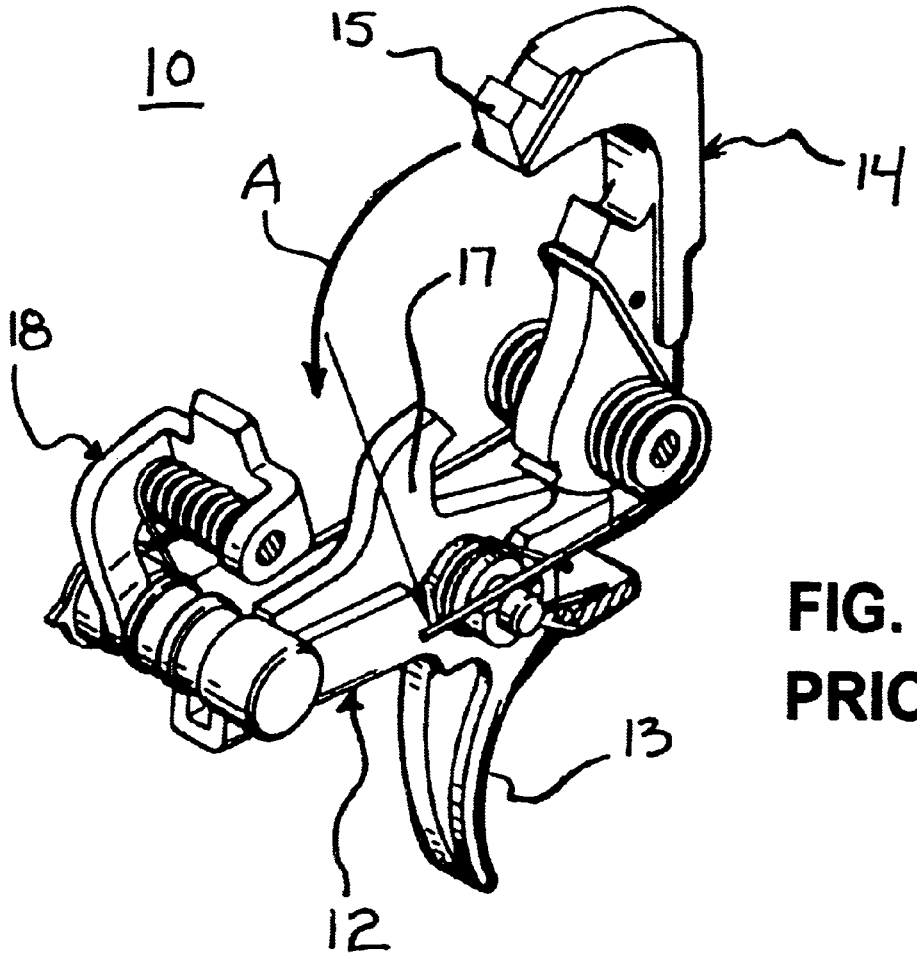
FIG. 1 PRIOR ART
FIG. 1 is a perspective view illustrating a prior art trigger mechanism.

Turning now to the drawings in which like reference characters indicate corresponding elements throughout the several views, attention is first directed to FIGS. 1 which illustrates a prior art trigger mechanism generally designated 10, for an M16 rifle. This particular trigger mechanism 10 allows selection between safe, semi-automatic, and fully automatic modes of operation. Trigger mechanism 10 includes a trigger assembly 12 having a trigger 13, a hammer 14 having a sear hook 15, a semi-automatic disconnector 17 and a sear assembly 18. Operation of mechanism 10 is well known to those skilled in the art and will not be described in detail, other than to describe how trigger snap, the sharp forward movement of trigger 13, occurs. After firing, hammer 14 is pivoted rearwardly in the direction of arrowed line A by the action of the bolt carrier (not shown). As hammer 14 is moved to a cocked position and beyond to a past-cocked position, the portion of hammer 14 having sear hook 15 strikes semi-automatic disconnector 17 which in turn imparts the energy from the striking hammer to a rear portion of trigger assembly 12, causing trigger 13 to sharply move or snap forward. This can be injurious or painful to the operator.

Figure 3:
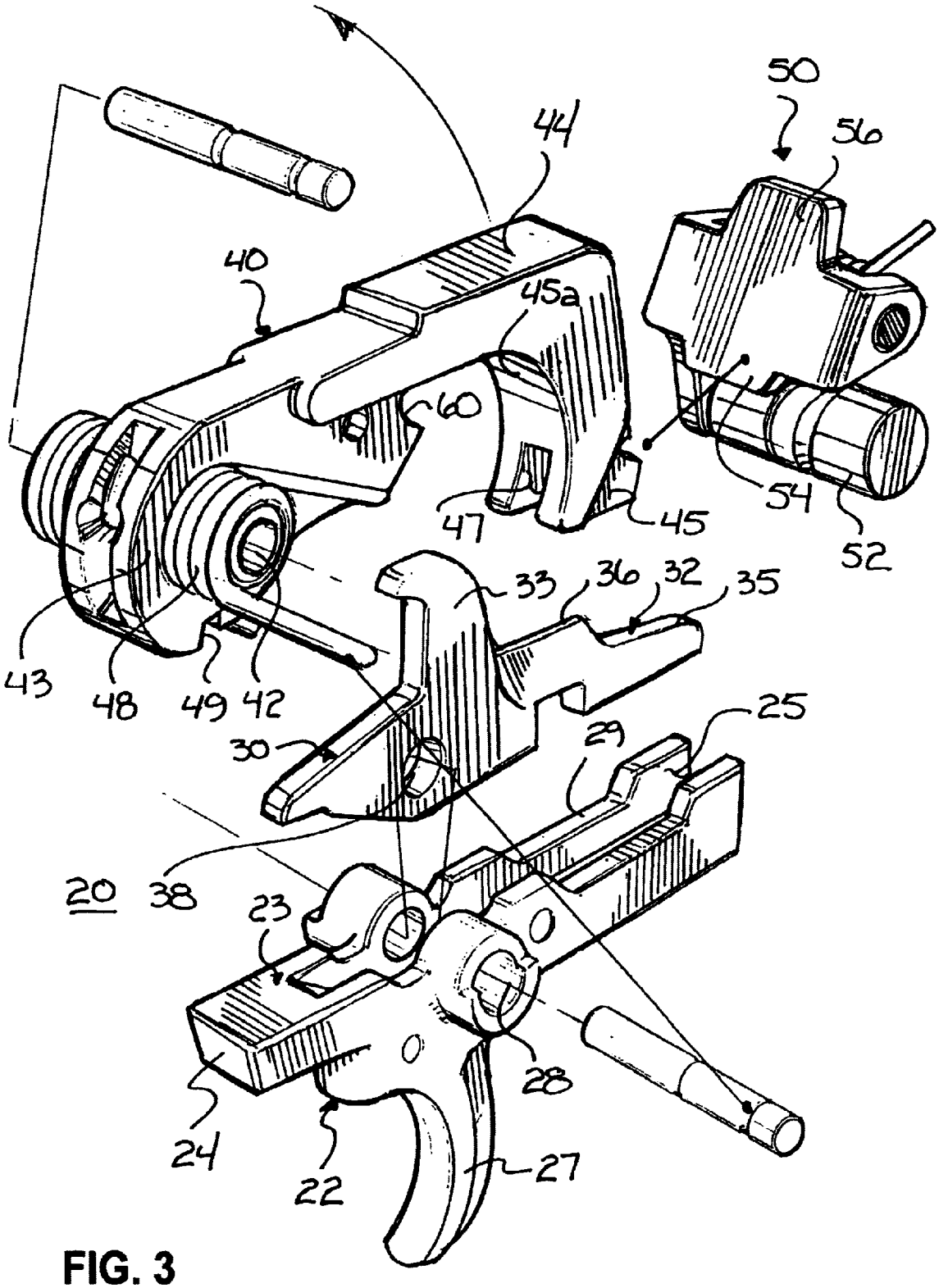
FIG. 3 is an exploded perspective view of the trigger mechanism of FIG. 2.

To overcome this problem, a trigger mechanism, generally designated 20 is provided. It will be understood that trigger mechanism 20 is intended to be employed with any of the various M16 type firearms having select fire capabilities. M16 type firearms include any of the M16 family or M4 family and any other firearm utilizing a similar trigger mechanism. It will also be understood that trigger mechanism 20 is carried by a lower receiver of a firearm. A lower receiver is not shown, as they are well known in the art and trigger mechanism 20 is carried in a conventional manner. Turning to FIGS. 2 and 3, trigger mechanism 20 according to the present invention includes a trigger assembly 22 having a trigger body 23 with a trigger nose 24 at one end and a trough 25 formed therein extending from the opposing end. A trigger 27 extends from trigger body 23 generally at a pivot 28. Specific notice should be taken that additional length has been added to the forward surface of trigger nose 24. Additionally, an upper edge or engagement edge of trigger nose 24 has been radiused to facilitate release of the hammer and reduce trigger creep, as can be seen in FIG. 4. In prior art mechanisms, the trigger nose has less length, and a sharply defined upper or engagement edge. Furthermore, a notch 29 is formed in trigger body 23, rearward of pivot 28.

Figure 9:
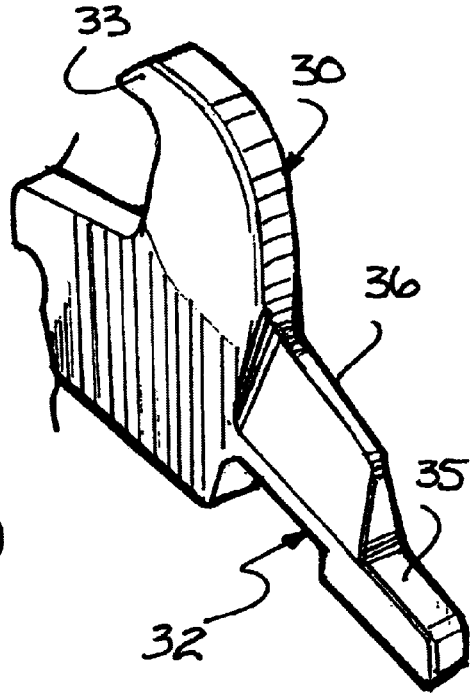
FIG. 9 is an enlarged partial perspective view of the semi-automatic disconnector according to the present invention.

Still referring to FIGS. 2–4, a semi-automatic disconnector 30 is positioned within trough 25 and pivotally coupled to trigger assembly 22 at pivot 28. With additional reference to FIGS. 8, 9 and 10, semi-automatic disconnector 30 includes a rearwardly extending disconnector lever 32 and an upwardly extending disconnector hook 33. Disconnector lever 32 is positioned within trough 25 and includes a cam surface 35, and a hammer receiving surface 36 intermediate cam surface 35 and disconnect hook 33. The purpose of the various elements of disconnector 30 will be described presently, however, it should here be noted that hammer receiving surface 36 preferably but not necessarily has beveled or tapered sides which reduce the width of the surface toward an apex. Semi-automatic disconnector 30 pivots about a pivot point 38, concurrent with pivot 28 of trigger assembly 22.

Referring back to FIGS. 2 and 3, trigger mechanism 20 also includes a hammer 40 coupled for pivotal movement at a pivot 42 defined at a pivot end end 43, from, a forward position rearwardly to a cocked position and beyond to a past-cocked position as the rearward most position. Hammer 40 further includes a striking surface 44 and a sear hook 45. Sear hook 45, although known in the art, has been modified by bifurcating it to create a notch 47. With additional reference to FIGS. 5, 6 and 7, the bifurcation of sear hook 45 by notch 47 is clear. Thus, when hammer 40 is pivoted beyond the cocked position to the past-cocked position, sear hook 45 does not engage hammer receiving surface 36 directly, but rather, receives this surface within notch 47. Sear hook 45 also does not contact trigger body 23 but is received by notch 29 instead. What does occur because of these modifications is that sear hook 45 engages disconnector 30 at a position wherein hammer 40 has moved further back in the cocking motion. Thus, a hammer spring 48 absorbs more of the energy, reducing the amount of energy transmitted to the trigger assembly 22. Additionally, with specific reference to FIG. 5, sear hook 45, when it finally does engage disconnector 30, makes contact at 45*a* proximate the tip of disconnector hook 33 and at an angle substantially directly toward pivot point 38. This means the moment angle of the forces which conventionally pivot the trigger assembly are eliminated or are at least very small, preventing or reducing the pivoting of trigger assembly 22. The lack of pivoting of trigger assembly. 22 eliminates the trigger snap found in convention trigger mechanisms.

With additional reference to FIG. 14, hammer 40 includes a trigger notch 49 formed in pivot end 43. Trigger nose 24 is received in trigger notch 49, holding hammer 40 in the cocked position prior to firing. In a conventional hammer, the trigger notch is formed perpendicular to the axis of rotation, directly in line with the center of pivot point 42. This, however, coupled with the acute angle o engagement with the trigger nose, results in a slight cocking action of the hammer before release, as the trigger is pulled. In the present invention, trigger notch 49 is slightly offset rearwardly from the center of pivot point 42, also resulting in a slightly changed angle toward neutral and away from a perpendicular or acute angle of engagement with trigger nose 24. The positioning of notch 49 combined with the lengthened forward surface of trigger nose 24 virtually eliminated cocking or rearward movement of hammer 40 during trigger pull.

Referring back to FIGS. 2 and 3, trigger mechanism 20 also includes an automatic sear 50 pivotally mounted to a firearm and moveable between and engage position and a disengage position. In the engage position, a selector 52 pivots a lower edge 54 forward. In the disengage position, the selector pivots the lower edge backwards. The disengage position can also be achieved by the bolt carrier striking an upper edge 56 of sear 50 after a round has been fired. In semi-automatic operation, sear 50 is moved to the disengage position. Upon pulling trigger 27, trigger assembly 22 is pivoted, lowering trigger nose 24 out of trigger notch 49 releasing hammer 40. After a round has been fired, the rearwardly moving bolt carrier engages hammer 40 and pivots it toward and beyond the cocked position to the past-cocked position. As described previously, sear hook 45 delays contact with diconnector 30 and contacts at an angle to prevent trigger snap. Disconnector hook 33 then engages hammer disconnect notch 60, formed in hammer 40 intermediate pivot end 43 and sear hook 45 preventing forward movement of hammer 40. When trigger 27 is released, it is biased forwardly with trigger nose 24 being received in trigger notch 49, holding hammer 40 in the cocked position. At the same time, disconnector hook 33 is pivoted rearwardly removing it from engagement with hammer disconnect notch 60. Hammer 40 is retained in the cocked position by trigger nose 24, preparatory to firing by another trigger pull.

Full automatic firing is achieved by utilizing selector 52 to move sear 50 into the engage position. At the same time, selector 52 engages cam surface 35 pivoting it downwardly resulting in diconnector hook 33 moving rearwardly. When the trigger is pulled and is held, hammer 40 pivots forwardly firing a round. The bolt carrier pivots hammer 40 rearwardly as described previously. The hammer then moves forwardly again because it is not held by trigger nose 24, which is still depressed, or diconnector hook 33 which is pivoted back so it will not engage hammer disconnect notch 60. At this point, forward movement of hammer 40 is arrested by sear hook 45 engaging lower edge 54 of sear 50. There is a momentary delay while the firing cycle progresses, then the forward movement of the bolt carrier, which strips and chambers another cartridge from a magazine contacts upper edge 56 of sear 50, automatically moving sear 50 to the disconnect position and releasing hammer 40 to fire another round and begin the cycle anew.

It will be understood by those skilled in the art that while trigger mechanism 20 of the present invention includes only a safe, semi-automatic, and fully automatic modes of operation, the semi-automatic disconnect can be replaced or supplemented by a burst disconnector as is well known in the art. Thus, a burst mode of operation can replace the fully automatic mode of operation, or both can be selectable.

Figure 11:
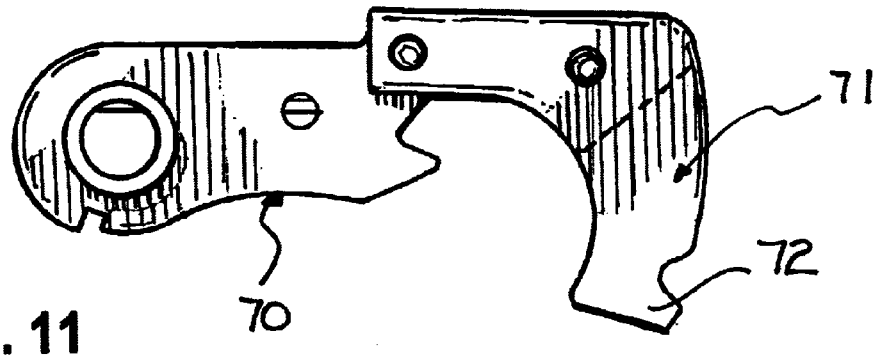
FIG. 11 is a side elevation of another embodiment of a hammer according to the present invention.
Figure 12:
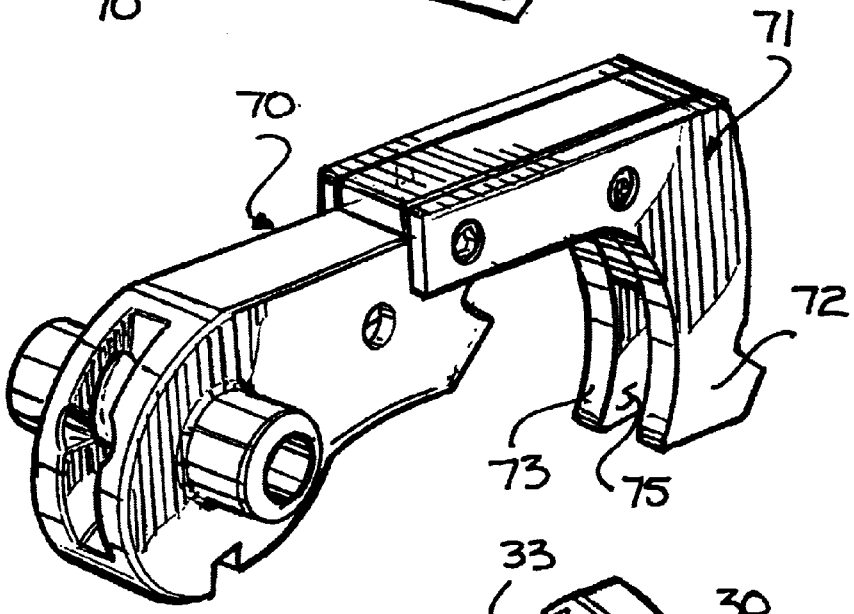
FIG. 12 is a perspective view of the hammer of FIG. 11.

Hammer 40 can be fabricated new by various fabrication techniques such as molding, machining, casting, and the like, or formed by modifying an existing hammer by cutting a notch, bifurcating the sear hook. Turning now to FIGS. 11 12 and 13, another embodiment of a hammer, generally designated 70 is illustrated. Hammer 70 is a conventional semi-automatic hammer which lacks a sear hook, as this element is required only for automatic or burst modes of operation. A bifurcated sear hook 71 is added by fastening hook plates 72 and 73 to opposing sides of hammer 70, defining a notch 75. Thus, hammer 70 can also be employed for automatic or burst modes of operation and operates as described in connection with hammer 40 in trigger mechanism 20.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. In a firearm having a trigger assembly with a trigger nose, a hammer with a sear hook and a trigger notch, a disconnector and an automatic sear, wherein the improvement comprises:

a notched bifurcating the sear hook of the hammer for receiving the disconnector in a past-cocked position; and the hammer pivots about a pivot point and the improvement further comprises the trigger notch being offset rearwardly from a center of the pivot point resulting in a slightly changed angle away from an acute angle of engagement with the trigger nose.

2. A firearm as claimed in claim 1 wherein the improvement further comprises the trigger nose having a length sufficient to engage the trigger notch and having a radiused engagement edge.

3. A trigger mechanism for use in a select fire M16 type firearm, the trigger mechanism comprising:

a trigger assembly having a pivot for pivotally coupling the trigger assembly to a firearm;

a disconnector having a pivot pivotally coupling the disconnector to the pivot of the trigger assembly;

a hammer pivotable about a pivot point between a forward position, a cocked position and a past-cocked position, the hammer having a bifurcated sear hook defining a notch, the disconnector receivable within the notch in the past-cocked position.

4. A trigger mechanism as claimed in claim 3 wherein the bifurcated sear hook contacts the disconnector substantially in line with the pivot of the disconnector and the pivot of the trigger assembly in the past-cocked position.

5. A trigger mechanism as claimed in claim 3 wherein the hammer includes a trigger notch formed proximate the pivot point, the trigger notch being offset rearwardly from a center of the pivot point resulting in a slightly changed angle away from an acute engagement angle with the trigger assembly.

6. A trigger mechanism as claimed in claim 5 wherein the trigger assembly includes a trigger nose having a forward surface of sufficient length to engage the trigger notch and having a radiused engagement edge.

7. A firearm comprising:

a lower receiver;

a trigger assembly having a pivot pivotally coupling the trigger assembly to the lower receiver;

a disconnector having a pivot pivotally coupling the disconnector to the pivot of the trigger assembly; and a hammer having a pivot pivotally coupling the hammer to the lower receiver, the hammer being pivotable about a pivot point between a forward position, a cocked position and a past-cocked position, the hammer having a bifurcated sear hook defining a notch, the disconnector receivable within the notch in the past-cocked position.

8. A firearm as claimed in claim 7 wherein the bifurcated sear hook contacts the disconnector substantially in line with the pivot of the disconnector and the pivot of the trigger assembly in the past-cocked position.

9. A firearm as claimed in claim 7 wherein the hammer includes a trigger notch formed proximate the pivot point, the trigger notch being offset rearwardly from a center of the pivot point resulting in a slightly changed angle away from an acute engagement angle with the trigger assembly.

10. A firearm as claimed in claim 9 wherein the trigger assembly includes a trigger nose having a forward surface of sufficient length to engage the trigger notch and having a radiused engagement edge.

11. A trigger mechanism for use in a select fire M16 type firearm, the trigger mechanism comprising:

a trigger assembly having a pivot for pivotally coupling the trigger assembly to a firearm and a trigger nose;

a disconnector having a pivot pivotally coupling the disconnector to the pivot of the trigger assembly;

a hammer pivotable about a pivot point between a forward position, a cocked position and a past-cocked position, the hammer includes a trigger notch formed proximate the pivot point for receiving the trigger nose in the cocked position, the trigger notch being offset rearwardly from a center of the pivot point resulting in a slightly changed angle away from an acute engagement angle with the trigger nose.

12. A trigger mechanism as claimed in claim 11 wherein the trigger nose includes a forward surface of sufficient length to engage the trigger notch and having a radiused engagement edge.

13. A trigger mechanism as claimed in claim 11 wherein the hammer includes a bifurcated sear hook defining a notch, the disconnector receivable within the notch in the past-cocked position.

14. A trigger mechanism as claimed in claim 13 wherein the bifurcated sear hook contacts the disconnector substantially in line with the pivot of the disconnector and the pivot of the trigger assembly in the past-cocked position.

15. A firearm comprising:

a trigger assembly having a pivot for pivotally coupling the trigger assembly to a lower receiver and a trigger nose;

a disconnector having a pivot pivotally coupling the disconnector to the pivot of the trigger assembly; and a hammer pivotable about a pivot point between a forward position, a cocked position and a past-cocked position, the hammer includes a trigger notch formed proximate the pivot point for receiving the trigger nose in the cocked position, the trigger notch being offset rearwardly from a center of the pivot point resulting in a slightly changed angle away from an acute engagement angle with the trigger nose.

16. A firearm as claimed in claim 15 wherein the trigger nose includes a forward surface of sufficient length to engage the trigger notch and having a radiused engagement edge.

17. A firearm as claimed in claim 15 wherein the hammer includes a bifurcated sear hook defining a notch, the disconnector receivable within the notch in the past-cocked position.

18. A firearm as claimed in claim 17 wherein the bifurcated sear hook contacts the disconnector substantially in line with the pivot of the disconnector and the pivot of the trigger assembly in the past-cocked position.

* * * * *